United States Patent [19]

Beaver et al.

[11] Patent Number: 4,557,810

[45] Date of Patent: Dec. 10, 1985

[54] BONDED ASBESTOS DIAPHRAGMS

[75] Inventors: Richard N. Beaver, Angleton, Tex.; Kenneth R. Evans, Russellville, Ark.; Donald D. Waters, Lake Jackson, Tex.

[73] Assignee: The Dow Chemical Company, Midland, Mich.

[21] Appl. No.: 679,519

[22] Filed: Dec. 7, 1984

Related U.S. Application Data

[62] Division of Ser. No. 270,769, Jun. 5, 1981, Pat. No. 4,530,749.

[51] Int. Cl.[4] ..... C25B 1/16; C25B 11/03; C25B 13/06

[52] U.S. Cl. ..... 204/98; 204/128; 204/252; 204/283; 204/295; 162/103; 162/153; 162/181.2

[58] Field of Search ..... 204/98, 128, 252, 283, 204/295; 162/103, 152, 153, 181.2

[56] References Cited

U.S. PATENT DOCUMENTS

| | | | |
|---|---|---|---|
| 3,723,264 | 3/1973 | Leduc et al. | 204/295 |
| 4,093,533 | 6/1978 | Beaver et al. | 204/295 |
| 4,173,526 | 11/1979 | Fang | 204/296 |
| 4,186,065 | 1/1980 | Dilmore et al. | 204/98 |
| 4,258,081 | 3/1981 | Kadija | 204/295 |
| 4,260,453 | 4/1981 | Hanmer | 204/295 |
| 4,354,900 | 10/1982 | Bailey et al. | 204/295 |

*Primary Examiner*—Andrew H. Metz
*Assistant Examiner*—Terryence Chapman
*Attorney, Agent, or Firm*—W. J. Lee; W. J. Lee

[57] ABSTRACT

The hydrophilicity and other properties of fluoropolymer-bonded asbestos diaphragms for use in brine electrolysis cells are improved by incorporating $Na_2CO_3$ into the aqueous slurry from which the diaphragms are prepared.

13 Claims, No Drawings

BONDED ASBESTOS DIAPHRAGMS

This is a divisional of application Ser. No. 270,769, filed June 5, 1981 now U.S. Pat. No. 4,530,749.

BACKGROUND OF THE INVENTION

The use of asbestos as a diaphragm material in electrolytic chlor-alkali cells is well known. Ordinarily the diaphragms are prepared by vacuum-drawing a slurry of asbestos fibers onto a porous cathode.

It has been previously taught that polymeric fluorocarbons (also known as fluoropolymers) may be used as binders for asbestos diaphragms. The technique involved is, in general, the mixing of particulate polymer binder material with the slurry of asbestos, then the drawing or depositing of the slurried materials in the form of a mat on the porous cathode, then heat-sintering to effect bonding. The fluoropolymers generally reduce the wettability of the diaphragms.

Of particular relevancy to the present invention is the fluoropolymer-bonded mixture of chrysotile asbestos and crocidolite asbestos disclosed in U.S. Pat. No. 4,093,533. These fluoropolymer-bonded mixtures of asbestos are suitable for use as membrane material in electrolytic chlor-alkali cells, withstanding even the harsh attack of highly acid electrolytes. However, there is a need to improve the wettability (hydroplilicity) of such diaphragms. Other patents relating to fluoropolymer-bonded asbestos diaphragms are referred to in U.S. Pat. No. 4,093,533.

The use of anolyte (NaCl brine) or catholyte (NaOH solution) as the aqueous medium for the slurry of asbestos and fluoropolymer have drawbacks. Any NaCl in the drawn diaphragm tends to cause accelerated rusting (chloride attack) of the foraminous steel cathode onto which the diaphragm is drawn and then heat-bonded. Any NaOH in the drawn diaphragm can cause caustic burns to workers performing the diaphragm-drawing and baking and it represents a safety hazard.

It is an object of the present invention to improve the hydrophilicity (wettability) of fluoropolymer-bonded asbestos diaphragms.

Another object is to provide an ingredient in a fluoropolymer-bonded asbestos diaphragm which not only improves the hydrophilicity of the diaphragm, but which is innocuous to persons preparing the diaphragms and which does not attack the ferrous cathode substrate.

SUMMARY OF THE INVENTION

The hydrophilicity and other properties of fluoropolymer-bonded asbestos diaphragms are improved by incorporating $Na_2CO_3$ into the aqueous slurry from which the diaphragms are prepared.

DESCRIPTION OF THE INVENTION

In the present invention the asbestos fibers are mixed in aqueous slurry with particulate fluoropolymers and $Na_2CO_3$ and the resulting slurried materials are deposited as a mat on the porous cathode substrate. The asbestos-coated cathode is dried and baked at elevated temperature to cause the polymer to bond to the asbestos and cause the asbestos fibers to be bonded to each other. The bonded asbestos diaphragm retains a significant amount of the $Na_2CO_3$ which remains dispersed therein after evaporation of the aqueous medium. When installed in an electrolytic cell for operation, the $Na_2CO_3$-containing bonded diaphragm is found to be easily wetted by the electrolyte and retains its good wettability during extensive operation of the cell.

Whereas the present use of $Na_2CO_3$ as an ingredient in a polymer-bonded asbestos diaphragm is operable with virtually any asbestos or mixtures of asbestos, it is preferred that mixtures of crocidolite/chrysotile be used.

The chrysotile fibers and the crocidolite fibers are preferably about ¼ inch or more in length and the fiber bundles, as normally mined, have been refined to open up the bundles. Commercially available refined asbestos is suitable for use in the present invention.

The fluorocarbon polymers (also called "fluoropolymers") may be solid, particulate polymers or copolymers of tetrafluoroethylene, trifluoroethylene, vinylidene fluoride, vinyl fluoride, monochlorotrifluoroethylene, or dichlorodifluoroethylene or may be fluorinated ethylene/propylene copolymer commonly known as FEP. Also, a copolymer of ethylene/chlorotrifluoroethylene known as Halar ® may be used. Preferably the fluorocarbon polymer is polyvinylidene fluoride, fluorinated ethylene/propylene copolymer, or polytetrafluoroethylene. Most preferably, the fluorocarbon polymer is polyvinylidene fluoride.

The ratio of chrysotile/crocidolite is in the range of about 90/10 to 20/80, preferably in the range of about 75/25 to about 40/60, most preferably the ratio is about 60/40 to about 50/50. Generally, it is preferred that there be more chrysotile than crocidolite.

The asbestos slurry may also contain minor amounts of impurities or processing aids such as surfactants, wetting agents, or dispersing agents, or modifiers, such as pH-adjusters, inorganic metal compounds, e.g., $TiO_2$, $CaCO_3$, $MgCO_3$, MgO, CaO, etc. Processing aids or modifiers may be employed in order to help disperse the fluorocarbon polymer and the asbestos fibers uniformly in the aqueous medium and to impart certain properties or features to the diaphragm.

The fluorocarbon polymer aqueous slurries or dispersions may be commercially available and generally contain such processing aids or modifiers as stabilizers, surfactants, dispersing agents, etc. Such polymer dispersions may also be prepared for use in the present invention by dispersing fine particle polymer in an aqueous medium by using wetting agents, surfactants, dispersing agents, or stabilizers which help to disperse the fluorocarbon polymers and/or stabilize such dispersions.

The asbestos and fluorocarbon polymer slurry is preferably deposited on the desired porous cathode structure by being vacuum-drawn. By vacuum-drawn it is meant that a slurry of the diaphragm ingredients (asbestos, polymer, modifiers, etc.) is contacted with one side of a porous cathode and "vacuum" (reduced pressure) is applied to the other side to pull the solids tightly into place against the cathode while pulling the liquid on through.

Other methods of depositing the diaphragm onto the cathode include the use of gravity flow or positive pressure to force the dispersion against a porous surface, thereby depositing the solids in the form of a mat or web while the liquid flows on through the porous surface. The mat or web of diaphragm material may be prepared on a surface other than the cathode surface (such as by using a Fourdrinier process) and then transferred to the cathode surface.

It is generally recognized in the art that chlorine cell diaphragms made of chrysotile asbestos have relatively poor resistance to low anolyte pH. Chrysotile asbestos fibers are relatively easily bonded together with polymeric fluorocarbons. Crocidolite asbestos fibers alone have good resistance to highly acidic (i.e., low pH) anolyte but are not readily bonded together with polymeric fluorocarbons to form a strong diaphragm. Thus, attempts to completely substitute acid-resistant crocidolite in place of chrysotile in polymer-bonded diaphragms have not generally been successful.

According to a preferred embodiment of the present invention, the acid-resistance of crocidolite and the bondability of chrysotile are made available in a diaphragm which employs both forms of asbestos. A blended composite of crocidolite and chrysotile asbestos, bonded with polymeric fluorocarbon, is found to be extremely stable in anolytes having a pH as low as about 0.5. By being able to operate at a low anolyte pH of about 0.5 to about 1.5, the life of graphite anodes is extended and graphite consumption per ton of chlorine produced is substantially decreased. Furthermore, the lower anolyte pH also increases chlorine purity from the cells as the production of other electrolytic products such as oxygen, carbon dioxide, and carbon monoxide is substantially inhibited. Chlorine producers are aware that an anolyte pH lower than about 1.5 will attack the normally-used chrysotile asbestos and result in its early destruction, therefore it has been common practice to operate at an anolyte pH of not lower than 1.5 in order to obtain appreciable life of the diaphragm, even though some sacrifice of the graphite anode life is encountered.

The following procedures and examples are illustrative of the present invention, except for those identified as being "comparative". Other embodiments of the present invention will become apparent to pracitioners of the art and the present invention is limited only by the claims attached hereto.

In general, the preferred method of preparing the present diaphragms for use in an electrolytic process wherein an aqueous NaCl solution is electrolyzed to produce chlorine, hydrogen, and sodium hydroxide is as follows:

1. The crocidolite fibers, chrysotile fibers, $Na_2CO_3$, and fine particle size polymeric fluorocarbon are intimately admixed and slurried in an aqueous media. The amount of fluorocarbon polymer employed may be from about 5 parts to about 100 parts per hundred parts of total asbestos; the preferred amount is about 10 to 50 parts with about 15–40 parts being most preferred.

2. The slurried ingredients are deposited on the foraminous cathode to the desired weight generally about 0.2 gms. to about 2.0 gms. per in.$^2$, and dried. Preferably, the weight is about 0.6 to about 1.4 gms./in.$^2$, most preferably about 1.0 to 1.2 gms./in.$^2$.

3. The so-coated cathode is subjected to a sufficient amount of heat to cause sintering of the polymer particles in the mixture; pressure may be applied, if desired, either by placing a positive force against the diaphragm or by using a vacuum (reduced pressure) on the other side of the foraminous cathode which will draw the diaphragm tightly against the cathode during the sintering operation. The amount of heat will depend, to a large extent, on which polymeric fluorocarbon is being used; the sintering temperature (or softening temperature) of the desired polymer is easily determined experimentally or is available in the publications.

4. The diaphragm-covered cathode is placed into position in the electrolytic cell and is wetted by water or aqueous electrolyte. Operation of the cell may then be started.

The electrolytic cell is the diaphragm type commonly used for electrolysis of brine to produce chlorine, caustic, and hydrogen. Historically, the diaphragm has been made of asbestos, the anode has been made of graphite, and the cathode has been made of iron or steel. The diaphragm is positioned between the cathode and the anode and electric current flows through the electrolyte (brine). The porosity of the diaphragm is important in that there must be some water-permeability without having so much permeability that the caustic in the catholyte flows freely into the anolyte. It is within the skill of practitioners of the chlorine cell art to adjust the porosity of the asbestos diaphragms to obtain optimum results for their particular operation.

More recently, metal anodes in place of graphite anodes have become commercially important. These generally comprise a metal substrate (e.g., titanium) coated with, e.g., an oxide of ruthenium, platinum, cobalt, and others; such metal anodes are essentially dimensionally stable, not having the wear-rates experienced with graphite. The pH of the electrolyte in the cell is an important factor in the wear-rate of the particular anode used. The bonded-asbestos diaphragm of the present invention can be used over a wide range of pH's and can be used with graphite anodes or metal anodes.

The following embodiments illustrate the practice of the present invention, but the invention is not limited to the particular embodiments shown.

EXAMPLE 1

About 279 gms. of refined asbestos fibers are thoroughly mixed with 6.9 liters of $Na_2CO_3$ solution which contains 100 gms. $Na_2CO_3$ per liter of solution. The mixer used is one which does not cut the asbestos fibers. Then about 27.9 gms. of finely-divided polytetrafluoroethylene (sold under the tradename TEFLON®) are mixed in, along with about 11.7 more liters of the $Na_2CO_3$ solution. Mixing is continued for a time to ensure substantially even distribution of the ingredients in the slurry. This final slurry contains about 15 gms. asbestos per liter of solution. A diaphragm is prepared by vacuum-drawing the slurry onto a foraminous cathode until the desired thickness of matte is reached. The mat is dried at 100° C., which evaporates the water from the asbestos, leaving $Na_2CO_3$ deposited throughout the diaphragm. The diaphragm is then bonded by heating at about 370° C. for about an hour, then cooled. The baked diaphragm is calculated as having about 10% $Na_2CO_3$ by weight.

The diaphragm is placed in a small laboratory chlor-alkali cell, brine is added to the anolyte section of the cell to the desired head, and when enough brine has percolated through the so-wetted diaphragm to fill the catholyte section to its overflow outlet, the cell is energized to begin electrolysis of the brine.

The above wetting time, during which the catholyte level rose to its overflow outlet was less than 1 minute. In contrast thereto, a bonded asbestos diaphragm made in accordance with the above method, except that the $Na_2CO_3$ is omitted, generally requires several hours to become thoroughly wetted, even when acetone or methanol is added to the anolyte to promote wetting.

The use of $Na_2CO_3$ in accordance with the present invention is found to be beneficial in that (1) it suspends the asbestos in water better than plain water and aids in "drawing" the diaphragm, (2) it coats and helps protect the crocidolite asbestos from oxidation during the high temperature bonding of the fluoropolymer, and (3) it acts as a wetting agent for the diaphragm during start-up of the cell and speeds up the attainment of proper levels of catholyte.

Ordinarily, the preferred amount of $Na_2CO_3$ deposited within the diaphragm, when the aqueous solvent evaporates, is in the range of about 5% to about 20% of the total diaphragm weight. The amount of $Na_2CO_3$ deposited is largely dependent on, and therefor controlled by, the concentration of the $Na_2CO_3$ in the aqueous slurry and the amount of aqueous solution remaining in the drawn diaphragm. The aqueous solution in which the asbestos and fluoropolymer are slurried contains an amount of $Na_2CO_3$ dissolved therein, preferably about 50 to about 200 gpl (grams per liter).

We claim:

1. A method for improving a fluoropolymer-bonded asbestos diaphragm for use in a brine electrolysis cell, the improvement consisting essentially of incorporating into the diaphragm during the making thereof, about 5% to about 20% by weight of $Na_2CO_3$.

2. The method of claim 1 wherein the fluoropolymer is at least one polymer or copolymer of tetrafluoroethylene, trifluoroethylene, vinylidene fluoride, vinyl fluoride, monochlorotrifluoroethylene, dichlorodifluoroethylene or fluorinated ethylene/propylene copolymer.

3. The method of claim 1 wherein the fluoropolymer is at least one of the group consisting of polyvinylidene fluoride, fluorinated ethylene/propylene copolymer and polytetrafluoroethylene.

4. The method of claim 1 wherein the asbestos is a mixture of chrysotile and crocidolite.

5. The method of claim 1 wherein the brine electrolysis cell is a chlor-alkali cell.

6. A method for preparing a polymer-bonded asbestos diaphragm for use in brine electrolysis, said method comprising, forming an aqueous slurry consistingly essentially of asbestos fibers, particulate polymer, and $Na_2CO_3$, depositing onto a foraminous metal cathode a wet mat of the asbestos fibers, particulate polymer, and $Na_2CO_3$, drying the so-formed mat to evaporate the water, leaving about 5% to about 20% by weight of $Na_2CO_3$ dispersed in the mat, and heating the mat at a temperature sufficient to cause the polymer to bond the asbestos fibers into a coherent structure.

7. The method of claim 6 wherein the concentration of $Na_2CO_3$ in aqueous solution is from about 50 to about 200 gpl.

8. The method of claim 6 wherein the concentration of $Na_2CO_3$ in the bonded diaphragm is about 10% by weight.

9. The method of claim 6 wherein the depositing onto a foraminous metal cathode is done by vacuum deposition.

10. A composite cathode structure for use in brine electrolysis, said composite comprising a foraminous ferrous metal substrate having, on at least a portion of its surface, a fluoropolymer-bonded asbestos diaphragm which contains dispersed therein, about 5% to about 20% weight of $Na_2CO_3$.

11. The composite of claim 10 for use in a chloralkali cell.

12. The composite of claim 10 wherein the foraminous substrate is a punched plate, woven wire mesh, or expanded sheet.

13. A method for brine electrolysis comprising passing a direct current through an aqueous NaCl electrolyte in an amount sufficient to electrolytically decompose the NaCl, said current being carried by the electrolyte through a $Na_2CO_3$-containing fluoropolymer-bonded asbestos diaphragm between anode and cathode, wherein the amount of $Na_2CO_3$ is in the range of about 5% to about 20% by weight of the diaphragm.

* * * * *